United States Patent [19]

Tillman

[11] 4,137,698

[45] Feb. 6, 1979

[54] METHOD AND APPARATUS FOR WINDING COVERED YARN

[75] Inventor: James E. Tillman, Hickory, N.C.

[73] Assignee: Southern Elastic Corporation, Longview, N.C.

[21] Appl. No.: 901,848

[22] Filed: May 1, 1978

[51] Int. Cl.[2] ..... D02G 3/36; B65H 54/08

[52] U.S. Cl. ..... 57/18; 57/17; 57/16; 57/313; 242/130.1

[58] Field of Search ..... 57/6, 16, 17, 18, 34 R, 57/91, 156; 242/18 DD, 46.21, 130, 1

[56] References Cited

U.S. PATENT DOCUMENTS

| | | | |
|---|---|---|---|
| 1,777,236 | 9/1930 | Swanson | 242/130.1 |
| 2,529,351 | 11/1950 | Putnam | 242/130.1 |
| 3,124,924 | 3/1964 | Smith | 57/18 |
| 3,133,401 | 5/1964 | Servage | 57/18 |
| 3,210,024 | 10/1965 | Weiss | 242/130.1 |
| 4,039,159 | 8/1977 | Shampagne | 242/130.1 |

*Primary Examiner*—Donald Watkins
*Attorney, Agent, or Firm*—Ron B. Moffitt

[57] ABSTRACT

Disclosed is a method and apparatus for winding covered yarn, namely non-elastic yarn twisted about a strand of elastomeric yarn, on a core to form a take-up package so that the wound covered yarn can be drawn (unwound) from the package without hanging up on itself or puckering. Winding of the take-up package is done on the same machine that performs the twisting operation and involves the following apparatus and method steps: providing a hollow core on which the covered yarn is to be wound, disposing a shaft assembly inside of the core, the shaft assembly having (a) a shaft, (b) first and second spaced apart disc means axially affixed to the shaft (one of the discs having a diameter larger than the other if the core is cone shaped), (c) a mass axially disposed on the shaft, lying between its midpoint and one of its free ends; providing covered yarn composed of an elastomeric filament about which at least one non-elastomeric filament is wound or twisted; and, then winding the covered yarn on the outermost surface of the core by rotating the core and shaft assembly.

15 Claims, 11 Drawing Figures

Fig. 8
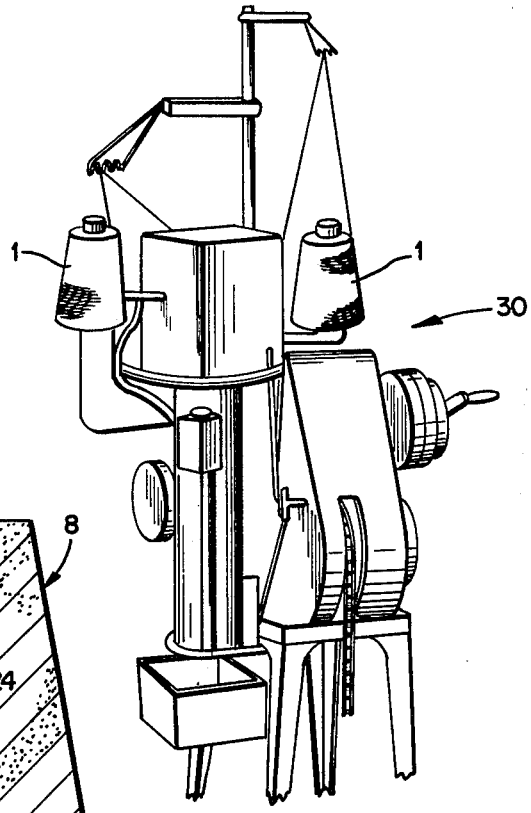
Fig. 10
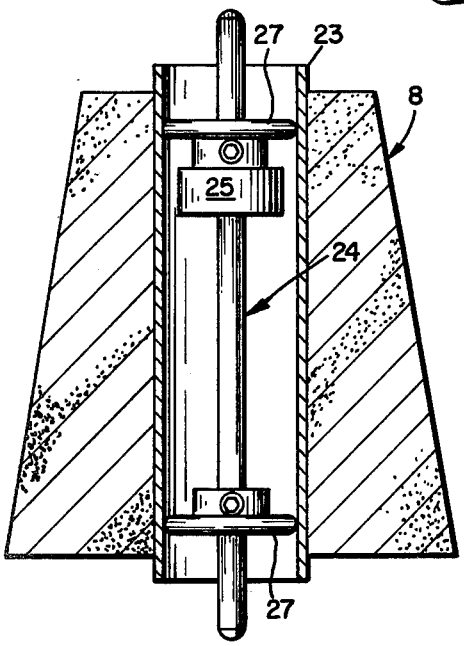
Fig. 11
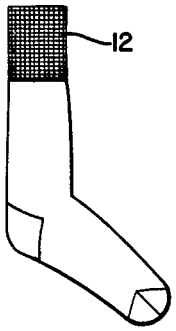
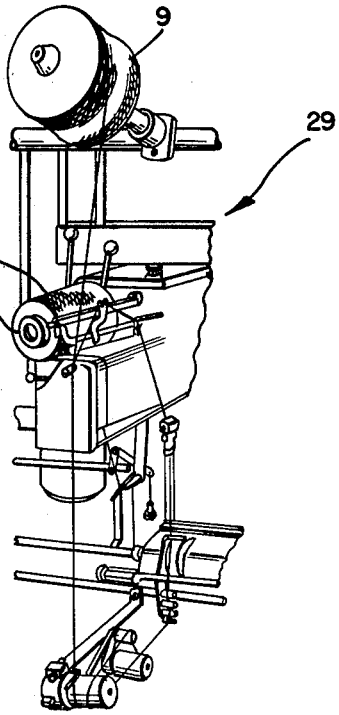
Fig. 9

METHOD AND APPARATUS FOR WINDING COVERED YARN

BACKGROUND OF THE INVENTION

The instant invention concerns itself with the production of covered yarn customarily used in the knitting of the uppermost portion of mens's knitted hosiery. See element 12 of FIG. 11 and element 30 of FIG. 8. The term "covered yarn," wherever used in this specification, is used to describe an elastomeric filament or strand about which there is twisted or wound at least one—more commonly two or more—"hard fibers." The term "hard fibers" wherever used in this specification denotes non-elastic filament or spun yarn. Covering an elastomeric member with a hard fiber produces a covered yarn composite with the following characteristics:

(a) controlled elongation and power,
(b) conventional (hard fiber) tactile aesthetics,
(c) improved abrasion resistance,
(d) higher strength, and
(e) improved stretch uniformity for subsequent processing.

Covered yarn for use in men's hosiery is manufactured with prior art machines called covering machines, for example covering machines manufactured by the Officine Meccaniche Menegattio Company of Monza, Italy and Arnold Machine Company, Inc., of Rockland, Massachusetts. Such machines are designed to draw an elastomeric filament from a source, wind or twist about such elastomeric filament at least one hard fiber and then wind the thus produced covered yarn on a core (a paper cone or cylinder), producing what is called in the textile trade a take-up package. Covered yarn drawn from a take-up package made by these machines does not have the desirable feeding or draw-off behavior, so vitally essential for use in the knitting of men's hosiery. Such yarn has the propensity to "hang up" and "pucker" and thus feed unevenly and undesirably in a knitting operation environment.

The above described lack of desirable draw-off behavior is overcome by a prior art separate rewinding operation performed by a coner apparatus shown generally in FIG. 9 by element 29. A take-up package of covered yarn 9 with undesirable draw-off properties is rewound on another core 6 on a machine called a coner (core is cone shaped), an example of which is the Schweiter KEK-PN Precision Cone Winder manufactured by Schweiter Limited, Hogen, Switzerland. The purpose of a coner is to create cones or packages 11 of covered yarn having desirable draw-off behavior. Without the use of a coner in a rewinding step, the take-up package of the covered yarn created by the use of a covering machine is unsuitable for use in a knitting machine environment. The extra coning step, the use of a coner in the coning operation to achieve a package of covered yarn having superior draw-off behavior, is the problem the instant invention solves.

Using the method and apparatus disclosed avoids completely the coning operation required by prior art practices. A covered yarn take-up package manufactured by the apparatus and method of the instant invention will have the same or superior draw-off behavior as cones of covered yarn manufactured using a coner. By following the teachings of the disclosed invention, capital investment required in a covered yarn manufacturing is reduced considerably, e.g. the cost of a coning machine or machines is eliminated, maintenance, labor and energy expense necessary to operate a coning machine is abolished and, as will be described hereafter in this specification, take-up packages are created that contain twice as much yarn, by weight, in comparison to the amount of covered yarn produced by a coning machine.

In its simplest form, the invention involves a covering machine take up package shaft assembly of prior art design modified by a mass disposed on the shaft of the shaft assembly. When such an assembly (shaft, spacer means and mass) is disposed in a core, on which covered yarn is to be wound and subsequently rotated, even slowly (7 to 9 rpm), there results a dynamic imbalance during rotation that causes the wound covered yarn to be more densely compacted on that portion of the core where the mass is located in comparison to the balance of the core. Such phenomenon causes a cone shaped bundle of wound yarn on a cylindrical shaped core as shown by element 8 of FIG. 10. It also causes cones of wound covered yarn on identically shaped cones to have yarn surfaces that deviate from the vertical by a measurable difference. Compare, for example, FIGS. 1 and 2.

SUMMARY OF THE INVENTION

The disclosed invention can be summarized as a method and apparatus of winding covered yarn comprising the following steps: First there is provided a hollow core, either cone or cylindrical in shape. Secondly there is disposed inside of the core a shaft assembly having (a) a shaft, (b) first and second spaced apart discs axially affixed to the shaft and positioned inwardly from the free edges of the core—in the event of a cone shaped core, one of the discs has a diameter larger than the other so as to conform to the interior configuration of the cone, (c) a mass axially disposed on the shaft between its midpoint and one of the free ends of the core—in the case of a cone shaped core, the mass is located between the shaft and midpoint and the terminal free end nearest the smaller of the two discs (small end of cone); thirdly, there is provided a covered yarn composed of an elastomeric filament about which there is wound or twisted at least one hard fiber; and, fourth, the covered yarn is wound on the outermost surface of the core by rotating the composite composed of the core and shaft assembly.

BRIEF DESCRIPTION OF THE DRAWINGS

FIG. 8 is a simplified schematic representation of a knitting machine of the type used in the manufacture of men's hosiery, showing feeding of covered yarn to it from a take-up package.

FIG. 9 is a schematic view of the essential elements of a prior art cone winder (coner) showing the coning of covered yarn taken from a take-up package made using a covering machine not using the method and apparatus of the instant invention.

FIG. 10 is a crossectional view of a take-up package of covered yarn made using the prior art covering machine of FIG. 7 modified by the apparatus used to practice the instant invention, i.e. a spindle assembly composed of a cylinder shaped core with a weight or mass on one end of a spindle disposed in the core.

FIG. 11 is a plan view of a typical men's sock containing covered yarn in its uppermost portion.

DETAILED DESCRIPTION OF THE INVENTION

Figure 1:
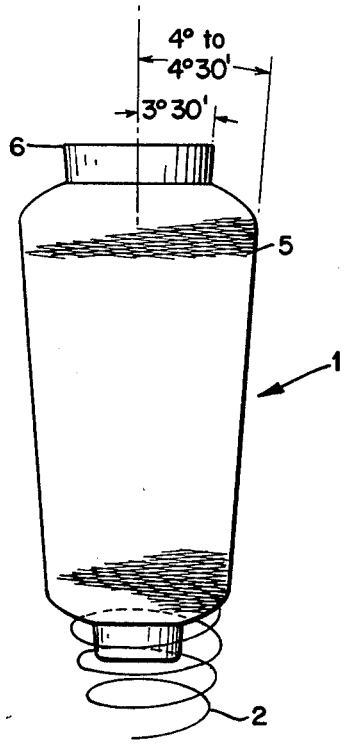
FIG. 1 is a front elevation of a cone of covered yarn (take-up package) made by a covering machine employing the method and apparatus of the instant invention, showing covered yarn being drawn off of the package.

Shown in FIG. 1 generally by element 1 is a take-up package made according to the instant invention composed of covered yarn 2, which can be of single, double or any other multiple of desired hard fiber coverage of an elastomeric core. Single and double coverage examples are shown as elements 3 and 4 in FIGS. 5 and 6 respectively. The outside surface 5 of the yarn 2 on take-up package 1 forms an angle within the range of 4° to 4° 30′ to the vertical whereas the cone as such, (element 6) on which the covered yarn is wound has an outside surface that makes an angle of 3° 30′ with the vertical, referred to in the trade as a 3° 30′ cone.

Figure 7:
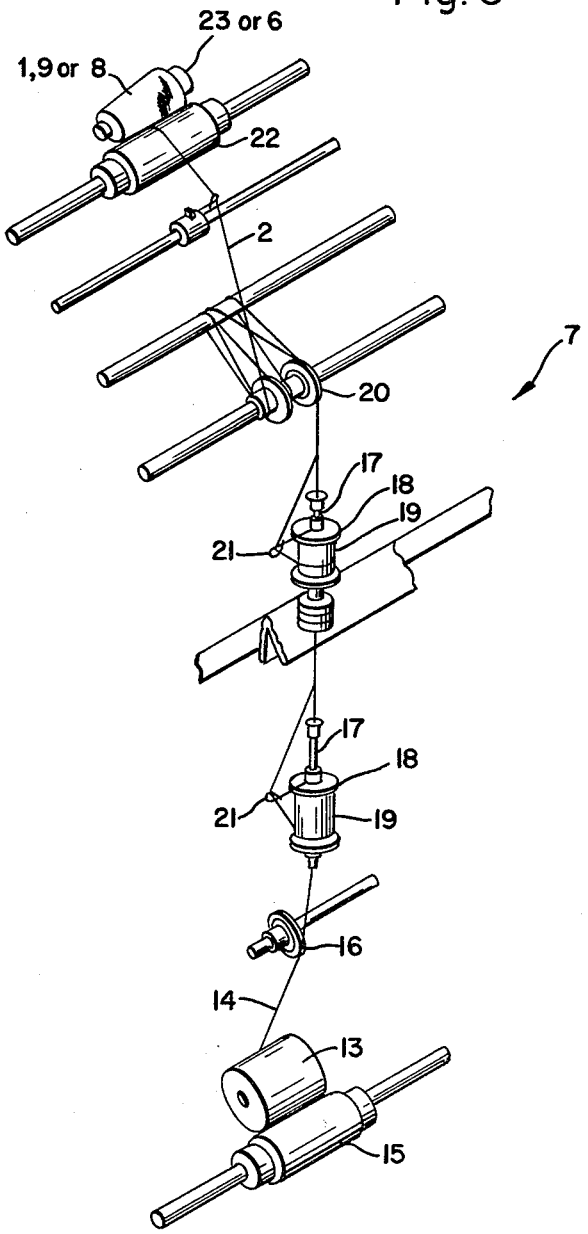
FIG. 7 is a schematic representation of the essential elements of a prior art covering machine used to make covered yarn.

A covering machine of prior art design, shown generally as element 7 of FIG. 7, modified by the method and apparatus of the instant invention—i.e. use of a composite of a core (cone or cylindrical shaped) in combination with a shaft assembly as more fully described hereafter—produced take-up packages 1 and 8 of FIGS. 1 and 10. On the other hand, the same prior art covering machine, unmodified by the method and apparatus of the instant invention, was used to produce the prior art take-up package generally shown as element 9 of FIG. 2. Such a take-up package has the same general configuration as that take-up package 1 in FIG. 1, but has a yarn surface 10 that makes an angle of approximately 2° with the vertical as opposed to the range between 4° and 4° 30′ of that of yarn surface 5 of element 1 using a 3° 30″ cone 6.

Figure 3:
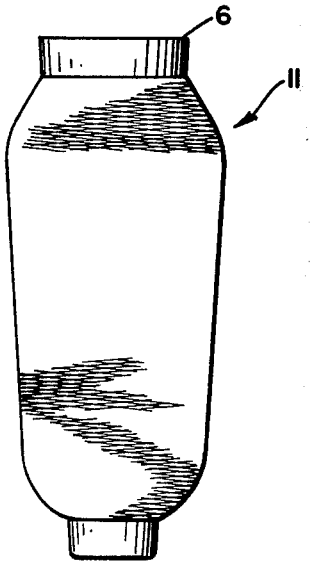
FIG. 3 is a front elevation of a prior art cone of covered yarn (pineapple shaped) take-up package, made by rewinding the covered yarn from the take-up package of FIG. 2 on a coner of FIG. 9.

A prior art problem of long standing is that take-up package 9 has undesirable draw-off characteristics and must be rewound on a coner like that shown generally as element 29 to produce a cone of covered yarn having desired draw-off behavior, shown generally as element 11 in FIG. 3. However, it has been discovered that take-up packages 1 of the instant invention have desired draw-off behavior, sufficient to enable them to be used per se with knitting machines, customarily used in the knitting of men's hosiery. Take-up package 1 contains 8 ounces of yarn (maximum load) on a 6⅝ inch 3° 30″ cone 6.

Shown generally as element 11 of FIG. 3 is a prior art pineapple shaped cone of covered yarn wound on the same size cone 6 (6⅝″, 3° 30″) but containing only half as much covered yarn, i.e. four ounces (maximum load). Covered yarn of the pineapple shaped cone has desirable draw-off behavior and is made pursuant to prior art practiced by using the take-up package of covered yarn 9, placing it on another machine, i.e. on a coner 29 of prior art design as a feed source, and rewinding the covered yarn on another cone shaped core (usually a 6⅝″ 3° 30″). The instant invention deletes this coning step but retains the results it produces, i.e. superior drawoff behavior.

Figure 2:
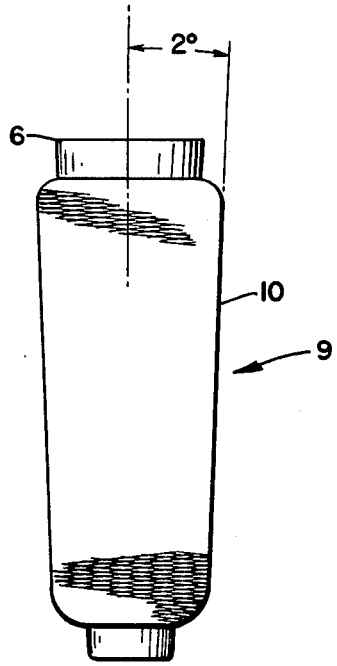
FIG. 2 is a front elevation of a cone of covered yarn (take-up package) made by a covering machine using prior art method and apparatus and ready to be rewound on a coner.
Figure 4:
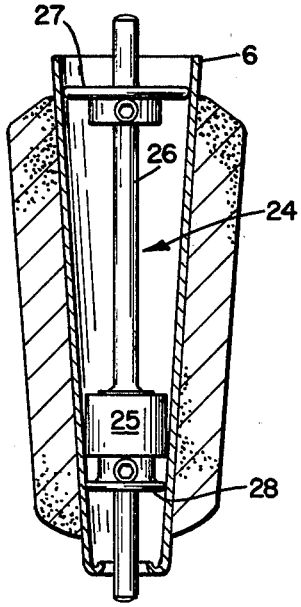
FIG. 4 is a crossectional view of the take-up package of FIG. 1, showing a shaft assembly as used inside of a cone shaped core during the manufacture of covered yarn.

Referring to FIG. 7, there is shown a schematic diagram of apparatus used to cover a filament of elastomeric yarn with one or more hard fibers to form the take-up package structure, when modified by the instant invention, shown in FIGS. 1, 4, and 10 and when unmodified, FIGS. 2 and 3. A supply package 13 (cylindrical shaped) containing the elastomeric yarn 14 to be covered is provided and is surface driven at a control rate of 7 to 9 rpm by drive roll 15. Elastomeric fiber 14 passes from the package 13 around a driven feed roll 16, called a star wheel and then passes successively through two hollow spindles 17, on which spools 18 are mounted containing hard fiber 19 and 19′ (assuming double coverage) and then to driven take-up star wheels 20. Spools 18 containing the hard fiber (covering fibers) 19 and 19′ are associated with means 21 used to wrap the hard fiber 19 and 19′ around the stretched elastomeric core fiber 14 with sufficient wraps per inch to give the yarn composite 2 predetermined stretch. Bottom cover yarn 19 normally controls the stretch, while top cover yarn 19′ serves to balance and give a smooth appearance to the surface of the covered yarn.

Above the take-up star wheel 20, covered yarn composite 2 is allowed to relax partially and is then wound into a take-up package 1 or 8 if the instant invention is followed or 9 if prior art practices are used, by rotating element 22 at a predetermined speed (7 to 9 rpm), which surface drives (rotates) the take-up package. The surface speed of the take-up package drive roll 22 (relative to that of the take-up star wheel 20) governs the amount of relaxation of covered yarn 2. Either a hollow cylinder 23 or a cone 6 can be used as a core on which the covered yarn is wound forming a covered yarn-core composite, i.e. a take-up package.

Figure 5:
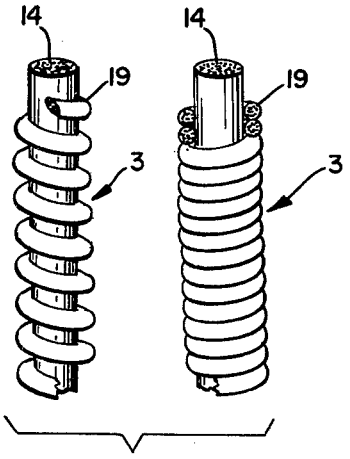
FIG. 5 consists of two schematic exploded views of covered yarn shown wound in a take-up package like those of FIGS. 1, 2, 3, 4 and 10, showing single coverage of hard fiber around a core composed of an elastomeric filament, one view showing the covered yarn during covering and the other view after the covered yarn is allowed to relax.

Referring to FIG. 5, shown generally by element 3 is a single covered yarn composed of element 14, a filament of elastomeric material about which is wound a non-elastic filament 19 of hard fiber. The left-hand view of FIG. 5 diagramatically describes the structure of a single covered yarn during its manufacture (unrelaxed state), whereas the right-hand view describes the same structure in the relaxed state in the take-up package composite 1.

Figure 6:
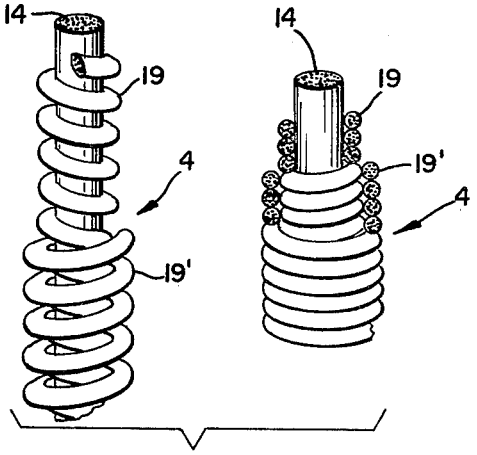
FIG. 6 consists of two schematic exploded views of covered yarn shown wound in a take-up package like those of FIGS. 1, 2, 3, 4 and 10 showing double coverage of a hard fiber around a core composed of an elastomeric filament, one view describing conditions during covering and the other view after the covered yarn has been allowed to relax.

Referring to FIG. 6, shown generally by element 4 is a double covered yarn composed of element 14, a filament of elastomeric material, about which is wound first and second non-elastic filaments 19 and 19′ (hard fiber). About first fiber 19 a second hard fiber 19′ is wound to form a double covered yarn. The left-hand view of FIG. 6 diagramatically describes the structure of a double covered yarn during its manufacture, whereas the right hand view describes the same structure in the relaxed state, i.e. in the take-up package composite 1.

A prior art take-up package made by the prior art method and apparatus, unmodified by the instant invention, is shown as element 9 in FIG. 2. It is to be understood, however, that such take-up packages do not have suitable draw-off characteristics to enable them to be used in a knitting machine environment. A subsequent coning operation is needed.

The instant invention employs the apparatus and method of prior art covering machines 7 of FIG. 7 modified by employing a unique shaft assembly core composite. Prior art shaft assemblies are similar to the shaft assembly of the instant invention, shown generally as element 24 in FIGS. 4 and 10, with one major and important difference. Prior art shaft assemblies do not have mass 25 axially affixed to shaft 26 as does the instant invention. To practice the instant invention either the shaft assembly core composite shown by elements 6 and 24 of FIG. 4 or 23 and 24 of FIG. 10, depending on the choice of a cone or cylinder shaped core is desired, is used in combination with the covering machine 7 of FIG. 7.

When practicing the instant invention using a cone shaped core 6, shaft assembly 24 of FIG. 4 is used. Shaft assembly 24 itself is composed of a shaft 26 on which there is disposed large and small discs 27 and 28 respectively and mass 25. Disc means 27 and 28 are used to center shaft 26 in the center of the cone shaped space enclosed by cone 6 and to carry the axially disposed mass 25. Disc 27 is obviously larger than disc 28 so as to conform to the cone shaped space created by cone core 6. Mass 25, for optimum results, should be located somewhere between the midpoint of shaft 26 and shaft 26 free end nearest the smallest sized disc 28. Any free end will do if the core is cylindrical shaped. Placement of the mass at one end or the other of a core causes the wound yarn on that portion of the core where the mass is located to have a composite density higher than the balance of the core.

Composite yarn density difference is demonstrated most visibly when a cylindrical shaped core is used in combination with a spindle having a weight or mass disposed at one end or the other. See spindle shaft 26, discs 27 and mass 25 in FIG. 10. Using the shaft assembly cylindrical core 24 and 23 of FIG. 10 on covering machine 7, wound yarn has a tendency to be compositely more dense on the end of cylinder 23 where the mass 25 is disposed than the balance of the core. Such produces a cone-shaped bundle of wound yarn 8 on a cylindrical core 23 having desirable draw-off properties. Without mass 25, a cylindrical shaped bundle of wound yarn would result not having desirable draw-off properties.

Mass 25 within the range of 3 to 3.5 ounces has been found satisfactory for a cone shaped core 6 measuring $6\frac{5}{8}$ inches in height, 1.75 inches in diameter for the large opening and 13/16 of an inch for the small opening. The same mass has been found satisfactory for a cylindrical shaped core 23 measuring 5.25" long with a diameter opening of $2\frac{3}{8}$".

On a cone shaped core as described above, 8 ounces of yarn can be wound into a single take-up package. On the same cone shaped core, not using the method of and apparatus of the instant invention but using a coner (FIG. 9), only 4 ounces of yarn can be wound. Advantages of more yarn per cone core are obvious: Saved are, time, labor, and expense during any subsequent knitting operation, expense of cores, additional labor, capital investment and energy that would otherwise be necessary for the coning operation.

Tension (percent elongation) of covered yarn wound using the method and apparatus of the instant invention as it exists in the take-up package is within the range of 2 to 3 percent, whereas the tension in the take-up package of the prior art cones 11 (FIG. 3) is between 5 to 6 percent. Covered elastic yarn wound under too tight or high amount of tension causes the yarn to contract when it is wound, especially in the center of a cone or cylinder of a take-up package. Tension causes the yarn to form collars at either end of the package, which are the cause of plucking or yarn hang up.

It is well known in the knitting art that human examination of a take-up package of covered yarn is insufficient to determine if the yarn on the take-up package will feed properly into a knitting machine, shown generally by element 30 of FIG. 9. Experienced knitters can be easily fooled. On the other hand yarn from take-up package cannot fool a knitting machine. Bad courses will result if there is the slightest plucking or hanging. Whether a particular take-up package will "run" (have adequate draw-off properties) only a knitting machine 30 can tell for certain. Take-up packages made using the method and apparatus of the disclosed invention have been knitting machine tested and found to have superior draw-off properties when compared to the properties of prior art packages, such as shown generally by element 11 in FIG. 3. Yarn drawn from a take-up package that will not feed properly into a knitting machine hang ups or plucking, causes bad courses in the knitted item. Such must be avoided at all cost.

In summation, the prior art required two steps, a covering and coning operation, and two machines, a covering machine and a coner, to produce a take-up package or cone of covered yarn having adequate draw-off properties. By using the above disclosed core and shaft assembly composite in combination with a prior art covering machine, the coning operation of the prior art is eliminated. Stated even more simply, by adding a weight or mass to one end of the shaft of a shaft assembly of prior art covering machine, an entire machine (a coner) and its operation is eliminated, and, a covered yarn take-up package is made having draw-off properties equal to or better than prior art cones of covered yarn that required a two-step, two machine process.

What is claimed is:

1. An apparatus for producing a take-up package of covered yarn composed of a hard fiber wound around an elastomeric filament comprising:

(a) a feed means for feeding a supply of elastomeric filament to a spindle assembly;

(b) at least one spindle assembly containing a rotatable spool containing hard fiber thereon and a means for winding the hard fiber around the elastomeric filament as it passes through the spindle assembly to produce the covered yarn; and, (c) a covered yarn take-up assembly composed of (i) hollow core means; (ii) a drive means for rotating said hollow core at a predetermined speed; (iii) a shaft assembly disposed in said core including a shaft, means for centering the shaft in said core, and a mass disposed on the shaft between its midpoint and one of its free ends for dynamically unbalancing the shaft assembly during rotation.

2. An apparatus as defined in claim 1 wherein said shaft assembly means for centering the shaft in the core comprises first and second spaced apart disc means axially affixed to said shaft.

3. An apparatus as described in claim 1, wherein said hollow core is cone shaped and said mass is closer to the smallest end of said cone.

4. An apparatus described in claim 1 wherein said drive means is comprised of a rotating mass having a surface adapted to frictionally engage the surface produced by covered yarn being wound on said core.

5. An apparatus as described in claim 2 wherein said spindle shaft has a length greater than said core so that a terminal portion of both of its ends protrude beyond the free edges of said core and each of said first and second spaced apart disc means are respectively spaced inwardly from one of the free edges of said core.

6. An apparatus as defined in claim 2 wherein said hollow core is cone shaped, one of said spaced apart discs has a diameter larger than the other and said mass is closer to the smaller of the two discs than to the other.

7. A method of winding covered yarn into a take-up package comprising:

(a) providing a hollow rotatable core means;

(b) providing a shaft assembly axially disposed inside of said core, the assembly having a (i) shaft and means for centering said shaft in said core and (ii) a mass axially disposed on a portion of the shaft lying between its midpoint and a free end of said shaft;

(c) providing covered yarn composed of an elastomeric filament about which is wound at least one relatively nonelastic filament; and (d) winding said covered yarn on the outermost surface of the core by rotating the core and shaft assembly.

8. A method as described in claim 7 wherein said shaft assembly means for centering said shaft comprises first and second spaced apart disc means axially affixed to said shaft.

9. A method of winding covered yarn as described in claim 8 wherein said core is cone shaped and one of said disc means has a diameter larger than the other and said mass is closer to the smaller disc than it is to the larger.

10. A method of winding covered yarn as set forth in claim 7 wherein the shaft has a length greater than said core so that a terminal portion of both its ends protrude beyond both free ends of said core.

11. A method of winding covered yarn as set forth in claim 7 wherein said core and shaft located therein is rotated by frictionally engaging the surface of a separate rotating means to the surface produced by covered yarn wound on said core.

12. A method of winding covered yarn as set forth in claim 7 wherein said rotation is between 7 and 10 rpm.

13. Apparatus for winding covered yarn comprising:

(a) a hollow core;

(b) a shaft assembly axially disposed in said core composed of a (i) shaft and means for centering said shaft in said core and (ii) a mass disposed on the shaft lying between its midpoint and one of its free ends for dynamically unbalancing the shaft assembly during rotation.

14. An apparatus as defined in claim 13 wherein said shaft assembly means for centering the shaft in the core comprises first and second spaced apart disc means axially affixed to said shaft.

15. An apparatus as described in claim 14 wherein said core is cone shaped, one of said discs has a diameter larger than the other, and said mass is closer to the smaller of the two discs than it is to the larger.

* * * * *